United States Patent [19]

Webb

[11] 3,955,621

[45] May 11, 1976

[54] RISER ASSEMBLY

[75] Inventor: Derrel D. Webb, Houston, Tex.

[73] Assignee: Houston Engineers, Inc., Houston, Tex.

[22] Filed: Feb. 14, 1975

[21] Appl. No.: 550,160

[52] U.S. Cl. ..... 166/.5; 175/7

[51] Int. Cl.[2] ..... E21B 43/01

[58] Field of Search ..... 166/.5, .6; 175/7, 321; 285/302

[56] References Cited

UNITED STATES PATENTS

| | | | |
|---|---|---|---|
| 3,179,179 | 4/1965 | Kofahl | 166/05 |
| 3,211,224 | 10/1965 | Lacy | 166/.5 |
| 3,280,908 | 10/1966 | Todd | 166/.6 |
| 3,313,345 | 4/1967 | Fischer | 166/.5 |
| 3,319,726 | 5/1967 | Brown | 175/321 X |
| 3,319,981 | 5/1967 | Burgess | 166/.5 X |
| 3,329,221 | 7/1967 | Walker | 175/321 X |
| 3,353,851 | 11/1967 | Vincent | 166/.5 X |
| 3,354,950 | 11/1967 | Hyde | 166/.5 |
| 3,496,999 | 2/1970 | Rowley | 166/.5 |
| 3,643,751 | 2/1972 | Crickmer | 166/.5 |

*Primary Examiner*—Frank L. Abbott
*Assistant Examiner*—Richard E. Favreau
*Attorney, Agent, or Firm*—W. F. Hyer; Marvin B. Eickenroht

[57] ABSTRACT

A riser assembly in which each of the riser pipe and choke and kill lines includes a telescoping joint in a lower portion thereof which is at least partially pressure balanced so that the upper end of the assembly may be fixed to the drilling vessel.

8 Claims, 3 Drawing Figures

RISER ASSEMBLY

This invention relates to improvements in a riser assembly for use in drilling a well at an underwater location.

In a well of this type, the riser assembly is suspended from a drilling vessel for extension downwardly to a blowout preventer stack at the upper end of the wellhead. The assembly includes a riser pipe connected in alignment with the bore through the preventer stack, and choke and kill lines carried by the riser pipe for extension longitudinally therealong to permit their connection to pipes on the stack leading to its bore beneath the rams. As well known in the art, when so connected, the riser pipe provides a large diameter conductor through which drilling equipment including a drill string may be run into and out of the well. During drilling operations, drilling mud circulated downwardly through the drill and bit at its lower end is returned upwardly to the drilling vessel through the annulus between the string and riser pipe.

As also well known in the art, the kill line provides a means by which drilling mud may be introduced into the well beneath closed preventer rams in order to "kill" the well, and the choke line has a choke at its upper end for controlling the flow of mud diverted into the choke line by the closed preventer rams in order to control a "kick". It is conventional practice to attach both such lines to the riser pipe for lowering therewith and to connect all three with the stack at the same time.

The riser pipe may be several hundred feet or more in length, and thus quite heavy, and in order to keep it from buckling, it is the general practice to maintain substantially its entire length in tension. In order to maintain the tension constant, regardless of the rise and fall of the vessel, the upper end of the riser pipe is suspended from complex and expensive tensioners on the drilling vessel. Also, the upper ends of the choke and kill lines are normally connected to parts of the vessel by means of flexible hoses to avoid damaging the lines as the vessel rises and falls.

An object of this invention is to provide a riser system which may be suspended from the drilling vessel without such tensioners and flexible hoses.

Another object is to provide such a system which may be so suspended regardless of the depth of wellhead beneath water level.

A further object is to provide such a system which is relatively inexpensive to manufacture.

These and other objects are accomplished, in accordance with the illustrated embodiments of the invention, by a riser assembly in which a lower portion of each of the riser pipe, choke line and kill line includes a telescoping or slack joint which is at least partially pressure balanced so as to extend and retract in response to rise and fall of the drilling vessel. Thus, an upward pull may be taken on the assembly to place all but its lower portion in tension, and the upper end thereof then fixed to the drilling vessel. More particularly, a means is provided for urging each joint to retracted position with a force that at least partially balances the "pump out" effect on the joint — i.e., the tendency for the joint to expand due to the differential pressure between the drilling mud inside and outside of the joint acting over the cross-sectional area of the inner section sealably slidable within the outer section.

In the illustrated and preferred embodiment of the invention, the joint of each of the choke and kill lines is pressure balanced by means of additional seals carried by the telescoping sections to form a pair of chambers between the sections, one of which is ported to the drilling fluid within the bore of the inner section and the other of which is ported to the drilling fluid on the exterior of the outer section. More particularly, the annular pressure responsive areas within the chambers are equal to the aforementioned cross-sectional area of the inner section so as to balance the vertical forces on the joint regardless of the pressure differential between the fluids internally and externally of the joint.

Since the riser pipe is of considerably larger diameter than the choke and kill lines, and would therefore require considerably larger balance chambers, it is instead pressure balanced by means of an additional seal carried by the inner section to form a chamber of relatively small cross-sectional area, and means for supplying an external source of fluid under pressure to the chamber at the pressure required to substantially balance the pump out effect on the joint. More particularly, the pressure of the source may be adjusted to permit balancing of the joint at the different depths at which it may be installed.

In one embodiment of the invention, such pressure is supplied to the chamber through a conduit leading to a source on the drilling vessel at water level. In another embodiment, it is supplied from a container carried by the assembly adjacent the riser pipe joint and having means for regulating the pressure of the fluid.

In the drawings, wherein like reference characters are used throughout to designate like parts:

Figure 1:
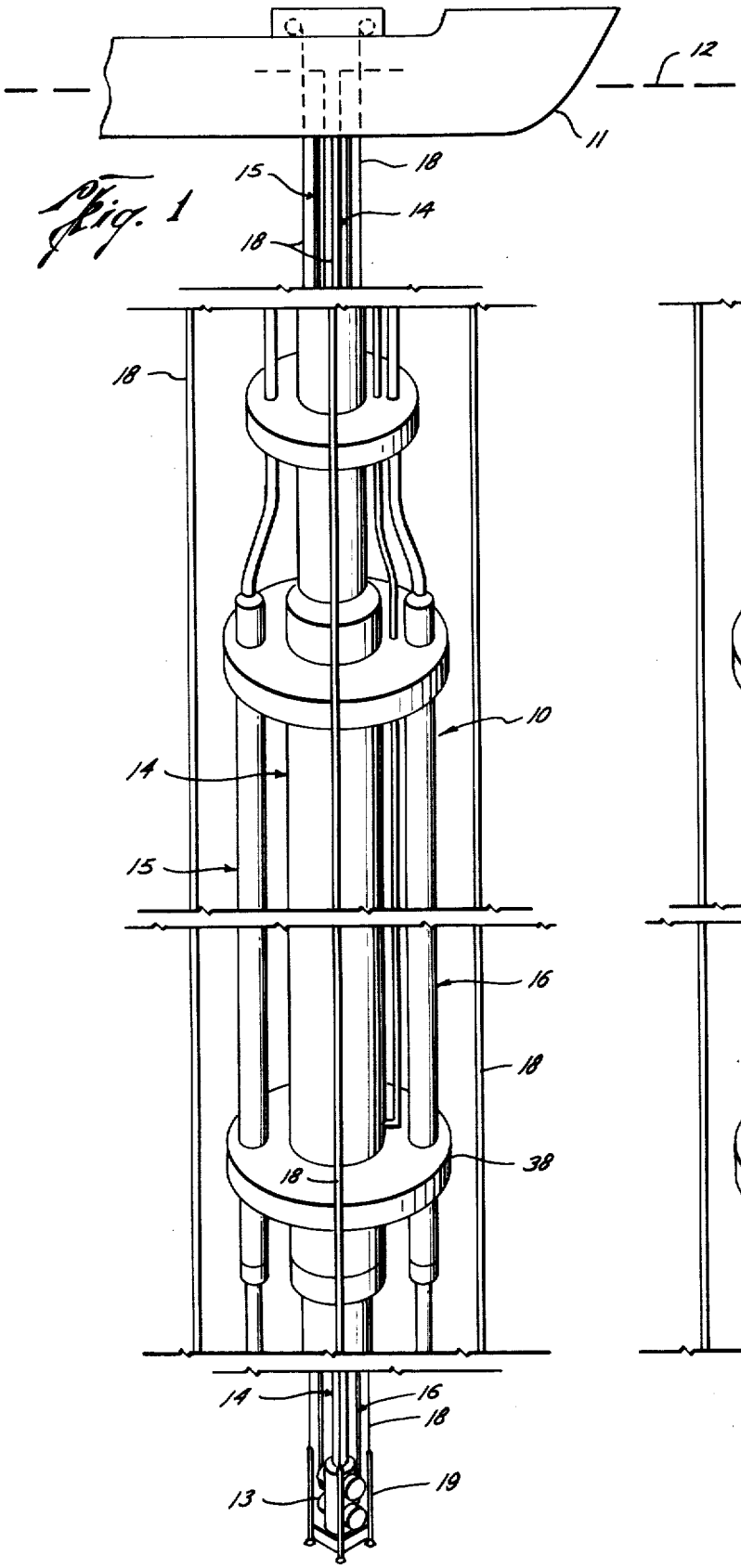
FIG. 1 is a perspective view of the lower portion of a riser assembly constructed in accordance with one embodiment of the present invention, the drilling vessel to which its upper end is connected and the wellhead to which its lower end is connected being shown on a reduced scale.

With reference now to the details of the above described drawings, the first embodiment of riser assembly 10, which is shown in FIG. 1 to extend between a drilling vessel 11 at water level 12 and a wellhead 13 located beneath the water level, comprises a riser pipe 14, a choke line 15 and a kill line 16. Each of the choke line and kill line is supported from the riser pipe for extension longitudinally therealong, and the entire assembly is lowered onto the upper end of wellhead 13 by suitable means (not shown) on the vessel. The riser assembly is guided as it is so lowered, as well as when it is raised from the wellhead, by means of a series of guidelines 18 extending between the vessel and guide posts 19 disposed about the wellhead. As well known in the art, arms (not shown) may extend outwardly from the riser assembly to support funnels adapted to slide downwardly over the guidelines and onto the posts 19 so as to align the lower end of the riser assembly with the upper end of the wellhead to which it is to be connected.

In a typical underwater wellhead installation, the lower end of the riser pipe is adapted to be releasably connected to the upper end of a blowout preventer stack on the upper end of the wellhead, and, when so installed, provides an upward continuation of the bore through the blowout preventer stack. The lower end of each of the choke and kill lines is adapted to be connected to a pipe leading to the bore of the preventer stack beneath one or more sets of preventer rams. Since connector apparatus suitable for this purpose is well known in the art, such as that shown on pages 5181–5189 of the 1974–75 issue of the "Composite Catalog of Oil Field Equipment and Services", the details thereof require neither description nor illustration.

In like manner, the upper end of the riser assembly including the upper ends of each of the riser pipe and choke and kill lines may be fixedly connected to the vessel by conventional means, including hoisting equipment on the drilling vessel for exerting an upward pull on the riser assembly, after its lower end has been connected to the wellhead, so as to place all but the lower portion thereof in tension. With the upper end of the riser assembly so connected, drilling operations may be performed through the riser pipe in a well known manner, with the choke and kill lines being filled with mud for use, as previously described, in the event of the need for same.

Figure 2:
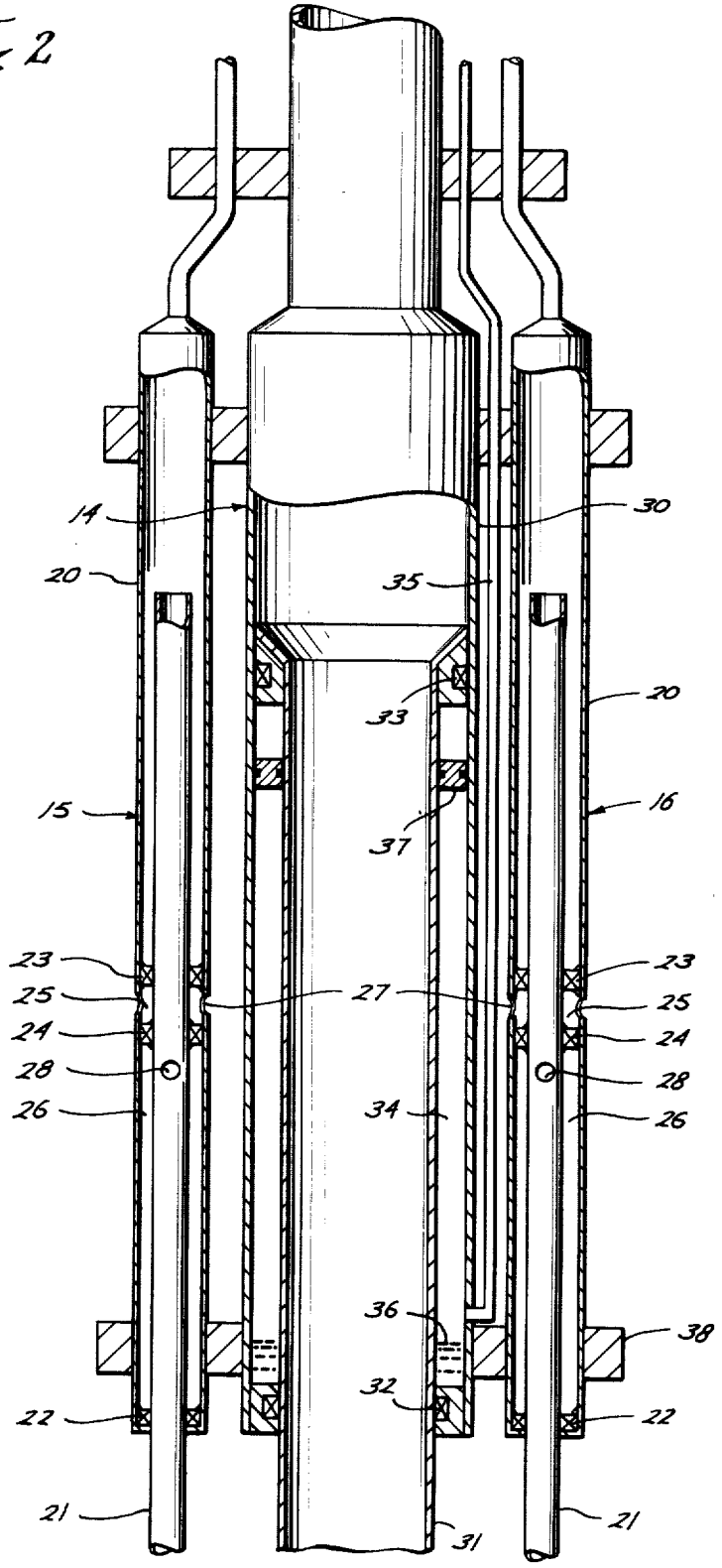
FIG. 2 is a diagrammatic vertical sectional view of the lower portion of the riser assembly shown in FIG. 1.

As best shown in FIG. 2, each of the choke and kill lines includes a telescoping joint in the lower portion thereof comprising an upper enlarged pipe section 20 and a lower reduced diameter pipe section 21 telescopically received in the section 20 and sealed with respect thereto by means of a seal ring 22 carried by the lower end of the upper section 20. Similarly, the riser pipe includes a telescoping joint in its lower portion which comprises an upper enlarged diameter pipe section 30 and a lower reduced diameter pipe section 31 telescopically received therein, with a seal ring 32 carried by the lower end of the outer section sealably sliding over the outer diameter of the inner section 31.

Since the wellhead may be several hundred feet or more beneath the water level, the hydrostatic pressure of the drilling mud in the lower portions of the above-described parts of the riser assembly may be quite high. As a result, there is a large differential between the pressure of the mud in the telescoping joint of each and that of the water surrounding such joints, and, as previously described, this differential would cause conventional telescoping joints to be pumped out — i.e., to extend to positions which would not permit the joint to extend and contract with rise and fall of the vessel.

Thus, in accordance with the present invention, each of the telescoping joints of the choke and kill lines is pressure balanced by means which includes a seal ring 23 carried by the outer section 20 for sealably sliding over the outer diameter of inner section 21 above the seal ring 22, and a seal ring 24 carried about the inner section for sealably sliding over the inner diameter of the outer section intermediate the seal rings 22 and 23. Thus, as shown in FIG. 2, an upper chamber 25 is formed between seal rings 23 and 24, and a lower chamber 26 is formed between seal rings 24 and 22.

Also, ports 27 are formed in the outer pipe section 20 to connect its exterior with the upper chamber 25, and ports 28 are formed in the inner section to connect its interior with the lower chamber 26. More particularly, the annular cross-sectional area within each of the chambers 25 and 26 is equal to the cross-sectional area of the inner pipe section 21, so that the telescoping joint is pressure balanced regardless of the pressure differential between the mud inside and the water outside of the joint.

The telescoping joint of the riser pipe may also be pressure balanced by means which includes a seal ring 33 which is carried by the inner pipe section for sealably sliding over the inner diameter of outer pipe section 30 above seal ring 32 so as to form a chamber 34 between the sections. A conduit 35 extends downwardly along the side of the riser pipe to connect at its lower end with the chamber 34 to permit fluid under a desired pressure to be introduced to the chamber to provide a force urging the inner pipe section to a retracted position.

As previously mentioned, since the fluid may be supplied from a source on vessel 11 at a relatively high pressure, the chamber 34 need have only a relatively small annular area. In this way, the outer section of the riser pipe need not be as large as it would be in the event the riser pipe telescoping joint were pressure balanced in the manner of the telescoping joints of the choke and kill lines. Also, of course, the source of pressure fluid at the level of the drilling vessel may be regulated in any suitable manner so as to substantially counteract the pump out effect of the telescoping joint of the riser pipe regardless of the depth at which it is located.

The pressure fluid filling the chamber 34 is an inert gas, such as nitrogen. Preferably, the gas contains oil which will settle out in the chamber, as indicated at 36, so as to provide a liquid seal above seal ring 32. Also, a floating piston 37 may be disposed within the chamber 34 above the inlet of the conduit 35 so as to contain oil above it and thus provide a liquid seal for the seal ring 33.

Figure 3:
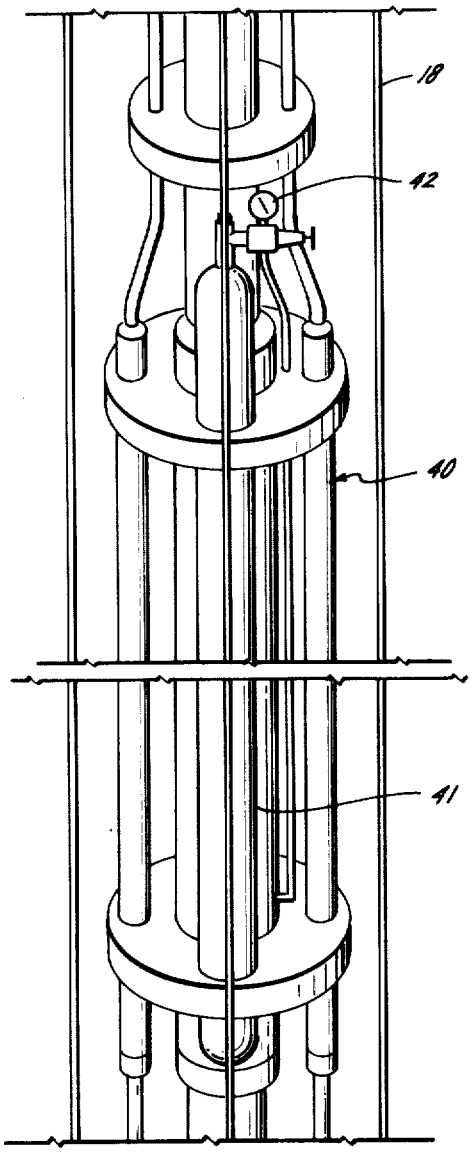
FIG. 3 is a perspective view, similar to FIG. 1, of the lower portion of a riser assembly constructed in accordance with another embodiment of the present invention.

The embodiment of the riser pipe assembly shown in FIG. 3, and indicated in its entirety by reference character 40, is identical in many respects to the riser assembly 10, thus bears many of the same reference characters. However, it differs from the riser assembly 10 in that pressure fluid is introduced into the chamber between the inner and outer pipe sections of the telescoping joint of the riser pipe from a container 41 carried by the riser pipe. In this way, pressure fluid for the chamber need not be conducted all the way downwardly from the water level, or from some other remote location. The pressure of the gas within the container 41 may be regulated in any suitable manner, such as by a regulator 42 on its upper end. This, of course, permits the riser pipe to be used in the desired manner regardless of the pressure at which it is to be disposed.

Each of the choke and kill lines may be held in desired spaced relation to the riser pipe by means of rings 38 carried by the riser pipe and through which the enlarged pipe sections of the choke and kill line extend.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the present invention without departing from the scope thereof, it is to be understood that all matter herein set forth or shown in the accompanying drawings is to be interpreted as illustrative and not in a limiting sense.

The invention having been described, what is claimed is:

1. A riser assembly adapted to be suspended at its upper end from a drilling vessel and connected at its lower end to a blowout preventer stack of an underwater wellhead, said assembly comprising a riser pipe including telescopically arranged sections, means carried by the riser pipe for urging the sections thereof toward retracted position with a force which counteracts at least a portion of the force due to pressure fluid within the pipe urging said sections to extended positions, a choke line and a kill line carried by the riser pipe for extension longitudinally thereof, each line including telescopically arranged pipe sections, and means carried by each line for urging the sections thereof toward retracted position with a force which substantially balances that due to pressure fluid within the line urging said sections to extended position.

2. A riser assembly of the character defined in claim 1, including means for adjusting the force with which the riser pipe sections are urged toward retracted positions.

3. A riser assembly of the character defined in claim 1, wherein said means for urging the riser pipe sections to retracted positions includes a source of pressure externally of the interior of the riser pipe.

4. A riser assembly of the character defined in claim 2, wherein the telescoping joints are near the lower ends of the riser pipe and choke and kill lines.

5. A riser assembly adapted to be suspended at its upper end from a drilling vessel and connected at its lower end to a blowout preventer stack of an underwater wellhead, said assembly comprising a riser pipe including telescopically arranged sections, means carried by the inner riser pipe section for sealably sliding over the inner diameter of the outer riser pipe section, means carried by the outer riser pipe section for sealably sliding over the outer diameter of the inner riser pipe section to provide a pressure chamber between the sealing means, and means for introducing pressure fluid from an external source into the chamber so as to urge said inner riser pipe section to a retracted position relative to said outer riser pipe section, and a choke line and a kill line carried by the riser pipe for extension longitudinally thereof, each line including telescopically arranged pipe sections, first and second means carried by the outer pipe section of each line for sealably sliding over the outer diameter of the inner pipe section of each line at spaced-apart locations along the length thereof, and third means carried by the inner pipe section of each line for sealably sliding over the inner diameter of the outer pipe section of each line intermediate the first and second sealing means to provide an upper pressure chamber intermediate the first and third sealing means and a lower pressure chamber intermediate the second and third sealing means, means connecting each upper pressure chamber to the outside of the outer pipe section of each line and means connecting each lower pressure chamber to the inside of the inner pipe section of each line, the outer diameter of the inner pipe section of each line sealably slidable within said first and second sealing means having a cross-sectional area substantially equal to the cross-sectional area of each of the first and second chambers.

6. A riser assembly of the character defined in claim 5, wherein the means for introducing pressure fluid comprises a conduit connected to and extending upwardly from the pressure chamber along the riser pipe.

7. A riser assembly of the character defined in claim 5, wherein the means for introducing pressure fluid comprises a container for the pressure fluid which is carried by the riser pipe and connected to the pressure chamber therein, said container having means for regulating the pressure of the fluid therein.

8. A riser assembly of the character defined in claim 5, wherein the telescoping joints are near the lower ends of the riser pipe and choke and kill lines.

* * * * *